US007028922B2

(12) United States Patent
Leonard et al.

(10) Patent No.: US 7,028,922 B2
(45) Date of Patent: Apr. 18, 2006

(54) SOAP DISPENSER SYSTEM AND VALVE ARRANGEMENT THEREFOR

(76) Inventors: Brian T. Leonard, 96 Pinecrest Dr., Woodcliff Lake, NJ (US) 07677; Thomas C. Hartmann, 10 Vanover Dr., Ledgewood, NJ (US) 07852

( * ) Notice: Subject to any disclaimer, the term of this patent is extended or adjusted under 35 U.S.C. 154(b) by 0 days.

(21) Appl. No.: 10/756,628

(22) Filed: Jan. 13, 2004

(65) Prior Publication Data

US 2005/0150909 A1 Jul. 14, 2005

(51) Int. Cl.
*B05B 7/30* (2006.01)

(52) U.S. Cl. ..... 239/318; 137/893; 137/4; 137/903

(58) Field of Classification Search ..... 222/181.3, 222/525, 630, 129, 372, 383, 385; 251/343; 137/893; 239/318; 4/903
See application file for complete search history.

(56) References Cited

U.S. PATENT DOCUMENTS

| | | | | |
|---|---|---|---|---|
| 2,201,528 | A | | 5/1940 | Freng |
| 3,083,915 | A | | 4/1963 | Grauel |
| 3,713,585 | A | | 1/1973 | Conklin |
| 4,193,520 | A | | 3/1980 | Duffield |
| 4,225,085 | A | | 9/1980 | Headen et al. |
| 4,358,056 | A | | 11/1982 | Greenhut et al. |
| 4,463,462 | A | | 8/1984 | Greenhut et al. |
| 4,505,407 | A | * | 3/1985 | Johnson ..... 222/181.1 |
| 4,901,765 | A | * | 2/1990 | Poe ..... 137/893 |
| 6,082,593 | A | * | 7/2000 | Borcherds ..... 222/181.3 |
| 6,209,184 | B1 | * | 4/2001 | Copeland et al. ..... 29/428 |
| 6,575,335 | B1 | * | 6/2003 | Lewis et al. ..... 222/156 |
| 6,808,149 | B1 | * | 10/2004 | Sendowski et al. ..... 248/311.3 |

* cited by examiner

*Primary Examiner*—Philippe Derakshani
(74) *Attorney, Agent, or Firm*—Richard M. Goldberg

(57) ABSTRACT

A soap dispenser system includes a venturi suction tube having a soap supply bore intersecting the main through bore; a soap dispenser controlling dispensing of soap from a container; and a supply tube connecting the soap dispenser to the soap supply bore of the suction tube; the soap dispenser including an inner tube having fluidly connected with the supply tube, an outer tube movably mounted over the inner tube and connected with the container, the outer tube fluidly connected with soap from the container and adapted to be fluidly connected with the inlet of the inner tube, a spring applying pressure between the inner tube and the outer tube in a direction to move them apart, a valve permitting soap to enter the inlet of the inner tube only when the outer tube is moved toward the inner tube against the force of the biasing device.

19 Claims, 13 Drawing Sheets

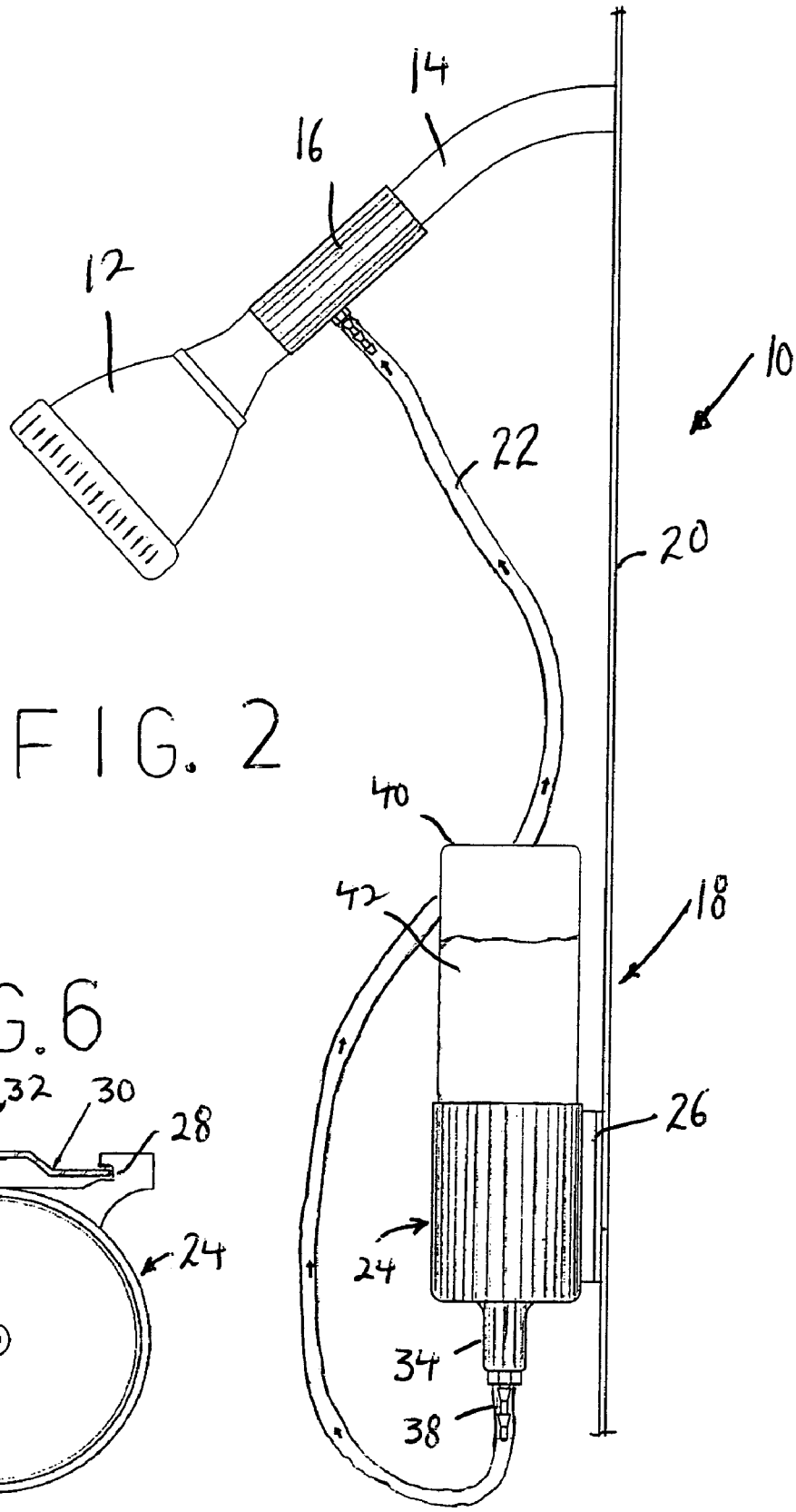
FIG. 2
FIG. 6
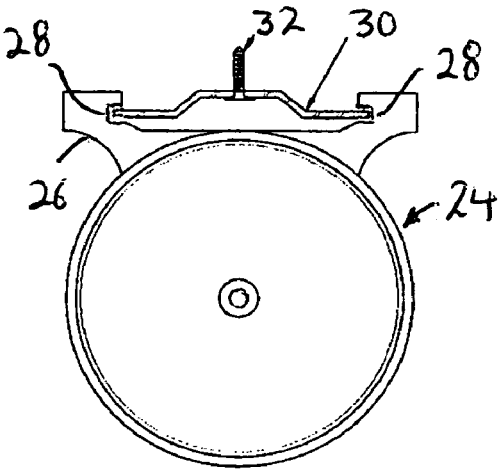

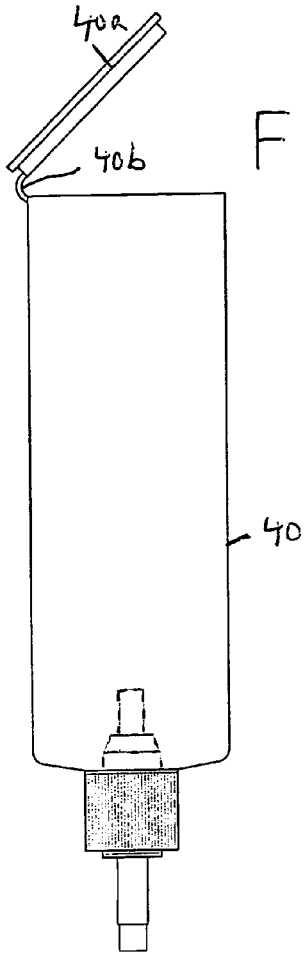
FIG. 22
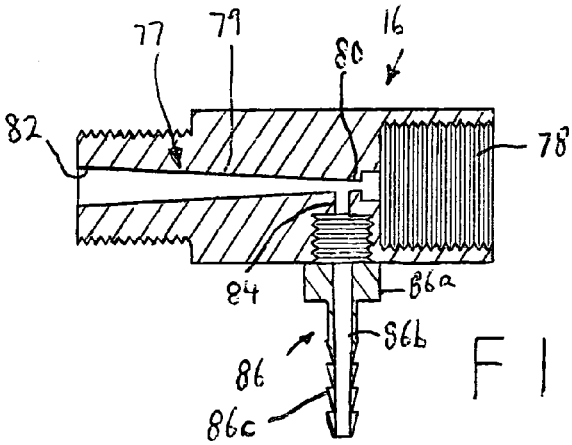
FIG. 9
FIG. 3
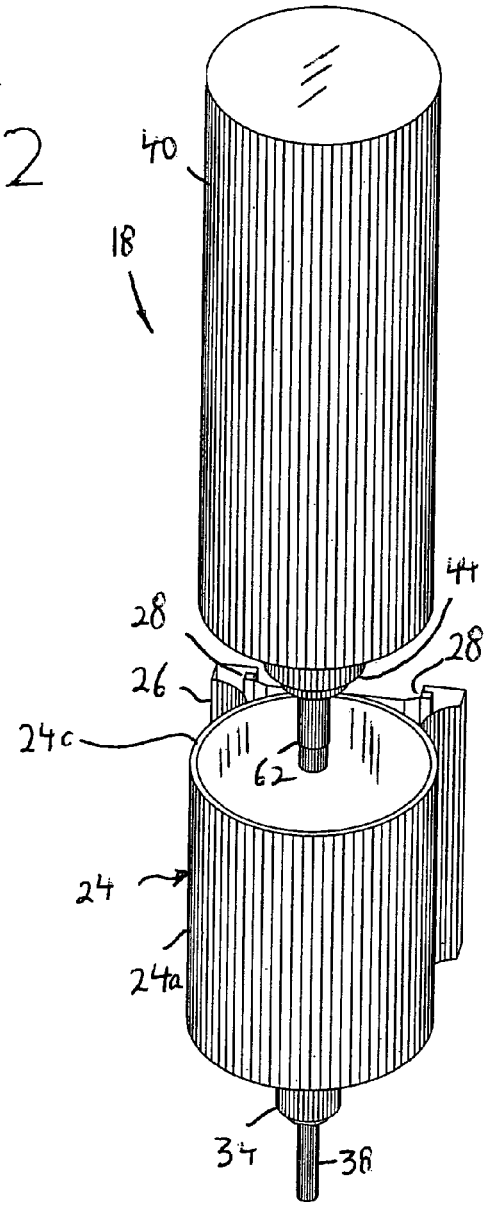

SOAP DISPENSER SYSTEM AND VALVE ARRANGEMENT THEREFOR

BACKGROUND OF THE INVENTION

The present invention relates generally to soap dispensers, and more particularly, is directed to a soap dispenser system particularly suitable for invalids and a valve arrangement therefor.

Most people use bar soap or liquid soap from a conventional squeeze bottle when taking a shower. Alternatively, it is known to provide a wall mounted soap dispenser in a shower with a push button at the bottom or side of the dispenser. However, the use of bar soap and conventional pump dispenser bottles can be difficult by invalids who have limited mobility and strength. Further, the valve arrangements used in the conventional pump dispenser bottles and the wall mounted soap dispensers are not entirely adequate for delivering metered doses of soap. Lastly, such arrangements are separate and apart from the water delivery in the shower.

OBJECTS AND SUMMARY OF THE INVENTION

Accordingly, it is an object of the present invention to provide a soap dispenser system and valve arrangement therefor that overcomes the problems with the aforementioned prior art.

It is another object of the present invention to provide a soap dispenser system and valve arrangement therefor in which the soap is delivered to the shower head to mix with the water.

It is still another object of the present invention to provide such a soap dispenser system and valve arrangement therefor in which the soap that is delivered to the shower head is a metered dose of soap.

It is yet another object of the present invention to provide a soap dispenser system and valve arrangement therefor in which the soap dispenser is easily activated by an invalid or any other person pressing down on the top of the soap dispenser.

It is a further object of the present invention to provide a soap dispenser system and valve arrangement therefor that is easy and economical to use and manufacture.

In accordance with an aspect of the present invention, a soap dispenser system comprises a suction tube including a main through bore for supplying water from a water line pipe to a shower head, and a soap supply bore intersecting the main through bore; a soap dispenser positioned remote from the suction tube for controlling dispensing of soap from a container having soap therein; and a supply tube connecting the soap dispenser to the soap supply bore of the suction tube in order to provide soap from the soap dispenser to the suction tube by means of suction created by the water traveling through the main through bore of the suction tube; the soap dispenser including an inner tube having an inlet and an outlet fluidly connected with the supply tube, an outer tube movably mounted over the inner tube and connected with the container, the outer tube having an inlet adapted to be fluidly connected with soap from the container and an outlet adapted to be fluidly connected with the inlet of the inner tube, a biasing device for applying pressure between the inner tube and the outer tube in a direction to move the inner tube and outer tube apart, a valve for permitting soap to enter the inlet of the inner tube when the outer tube is moved toward the inner tube against the force of the biasing device and which prevents soap from entering the inlet of the inner tube when the outer tube is moved away from the inner tube by the biasing device.

In a preferred embodiment, the valve includes a member which covers the inlet of the inner tube when the biasing device moves the inner tube and the outer tube apart and which uncovers the inlet of the inner tube when the outer tube is moved toward the inner tube against the force of the biasing device. The member of the valve includes an inner wall which covers and uncovers the inlet of the inner tube and an outer wall connected with the inner wall and which engages with the outer tube for moving the inner wall relative to the inner tube to cover and uncover the inlet of the inner tube. The outer wall is in frictional engagement with the outer tube.

The inner tube includes a first stop for limiting movement of the inner wall therealong in a first direction to a first position in covering relation to the opening and a second stop for limiting movement of the inner wall therealong in a second opposite direction to a second position in uncovering relation to the opening.

The biasing device includes a coil spring connected between the inner tube and the outer tube. There is also a free floating ball between the spring and the outer tube for providing a seal of the inlet of the outer tube when the outer tube is moved toward the inner tube against the force of the biasing device and which releases the seal of the inlet of the outer tube when the outer tube is maintained in a position moved toward the inner tube.

Preferably, the outer tube is secured to a neck of the container.

In another embodiment, the valve of the soap dispenser includes a first biased seal for permitting soap to travel through the inner tube when a release force is applied to the container and for preventing soap to travel through the inner tube when a the release force is not applied to the container, a second biased seal for preventing soap from escaping from the container through the outer tube when the release force is applied to the container and for permitting soap to escape from the container through the outer tube when the release force is not applied to the container, and a chamber between the first and second biased seals for accumulating a metered dosage of soap for supply to the supply tube, such that the chamber is loaded with the metered dosage of soap when the release force is not applied to the container, and the metered dosage of soap is supplied through the inner tube when the release force is applied to the container.

In the other embodiment, the inner tube includes an inner sealing surface and the first biased seal includes a ball and a spring mounted in the inner tube for biasing the ball into sealing engagement with the inner sealing surface, and the outer tube includes an inner sealing surface and the second biased seal includes a ball and a spring mounted in the outer tube between the inner tube and the ball for biasing the ball into sealing engagement with the inner sealing surface. The inner sealing surface of the outer and inner tubes is a part-spherical surface.

The suction tube is a venturi suction tube having a main through bore which flares outwardly in diameter from an inner end to an outer end thereof the soap supply bore is fluidly connected to the main through bore adjacent the inner end. In one embodiment, the suction tube includes an outer surface having a recess therein, and a hollow central post in the recess which is in fluid communication with the soap supply bore, the hollow central post having a free end which substantially does not extend radially outward past the outer surface.

The soap dispenser includes a cup adapted to be mounted to a wall of a shower, the cup having a spout connected with the supply tube, and the inner tube being mounted in the cup in fluid communication with the spout. The cup also includes a bottom wall and an internal boss connected with the bottom wall for mounting the container in spaced relation from the bottom wall. There is also at least one opening in the bottom wall, with the container in spaced relation from the bottom wall.

The above and other objects, features and advantages of the invention will become readily apparent from the following detailed description thereof which is to be read in connection with the accompanying drawings.

BRIEF DESCRIPTION OF THE DRAWINGS

FIG. 2 is an enlarged elevational view of the soap dispenser system and valve arrangement therefor;

FIG. 3 is a perspective view of the soap dispensing bottle and cup holder;

FIG. 6 is a top plan view of the cup mounted to the mounting plate;

FIG. 9 is cross-sectional view of the venturi suction tube;

FIG. 22 is an elevational view of a modified bottle according to the present invention.

DETAILED DESCRIPTION

Figure 1:
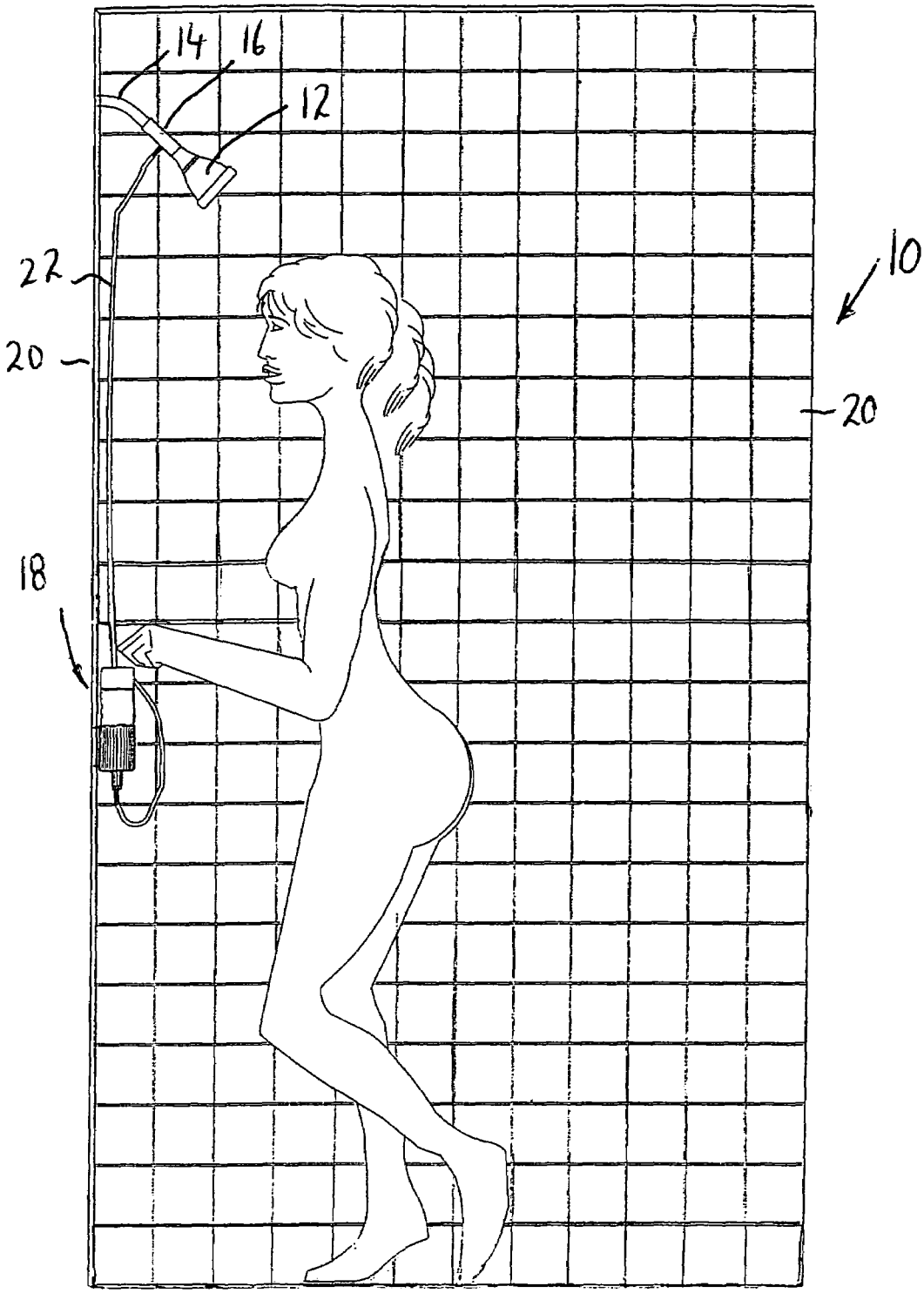
FIG. 1 is an elevational view of a soap dispenser system and valve arrangement therefor according to a first embodiment of the present invention in use in a shower.
Figure 4:
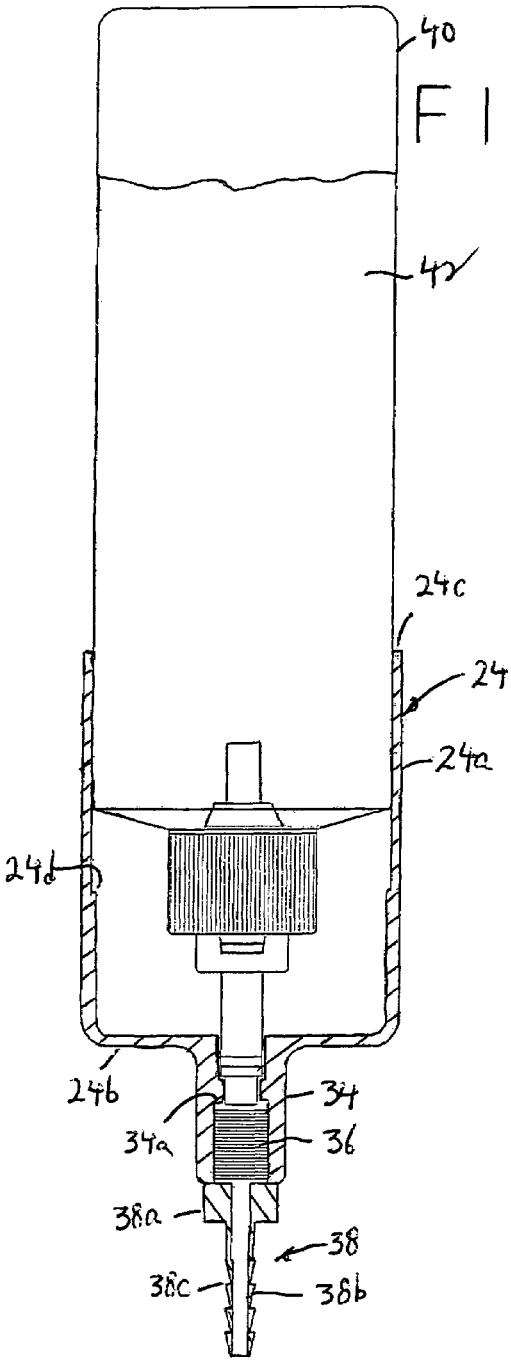
FIG. 4 is a cross-sectional view of the cup and hose barb, assembled with the bottle and valve arrangement.

Referring to the drawings in detail, and initially to FIGS. 1 and 2 thereof, a soap dispenser system 10 according to the present invention includes a conventional shower head 12 connected to a water line pipe 14 through a venturi suction tube 16. A soap dispenser 18 is mounted to the shower wall 20 and is connected via a supply tube 22 to venturi suction tube 16 in order to provide a metered dose of soap which is supplied to venturi suction tube 16 by means of suction created by the water traveling therethrough.

As shown in FIGS. 3–6, soap dispenser 18 includes a cylindrical cup 24 having a cylindrical wall 24*a*, a closed bottom wall 24*b* and an open upper end 24*c* mounted to a bracket 26 having opposing vertically oriented channels 28 which are closed off at the upper ends thereof by a closure plate (not shown). A bracket plate 30 is mounted to shower wall 20 by a bolt 32, with opposite side edges of bracket plate 30 fitting in channels 28 in order to secure cup 24 to shower wall 20.

A hollow cylindrical spout 34 extends down coaxially from closed bottom wall 24*b* and can be provided with internal threads 36. The inner surface of spout 34 is provided with an annular shoulder 34*a*. Further, the inner surface of cylindrical wall 24*a* is provided with an annular shoulder 24*d*, the purpose for which will become apparent from the discussion hereinafter.

A hose barb 38 or other suitable means such as a tube is secured to the lower end of spout 34 so as to extend down therefrom. Hose barb 38 includes a securing section 38*a* which is secured to the lower end of spout 34 by any suitable means, such as adhesive or screw threads which engage threads 36. A nozzle section 38*b* extends down from securing section 38*a* and has barbs 38*c* on the outer surface thereof. In this manner, one end of plastic supply tube 22 can be secured over barbs 38*c* to nozzle section 38*b*.

A bottle 40 containing soap 42 or any other household bathing product has a reduced diameter neck 44 at one end with external threads 46 for receiving a closure cap (not shown) as is conventional.

Figure 5:
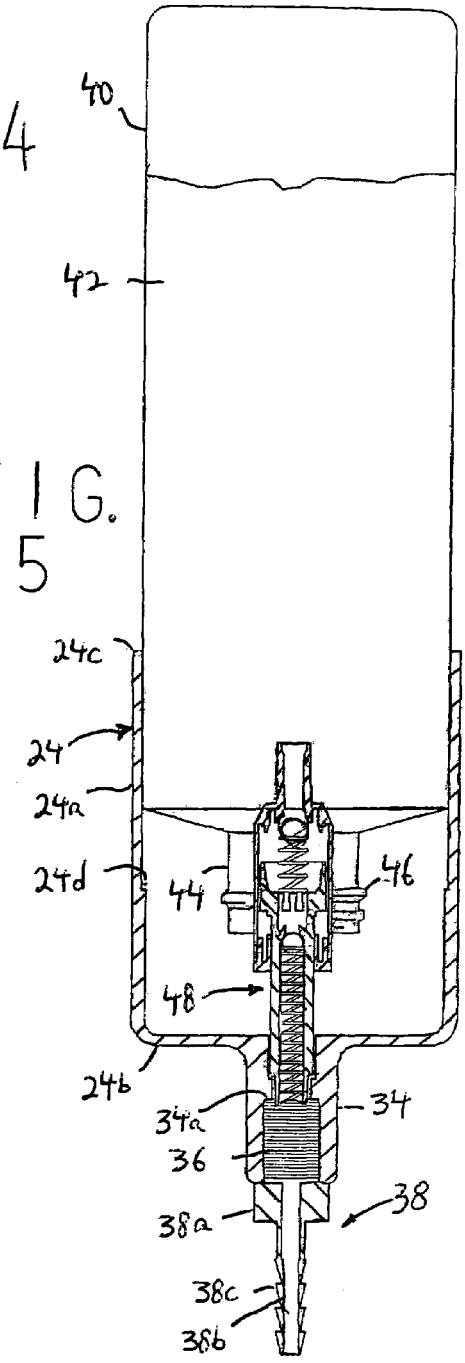
FIG. 5 is a cross-sectional view of the cup, hose barb and valve arrangement, assembled with the bottle.
Figure 7:
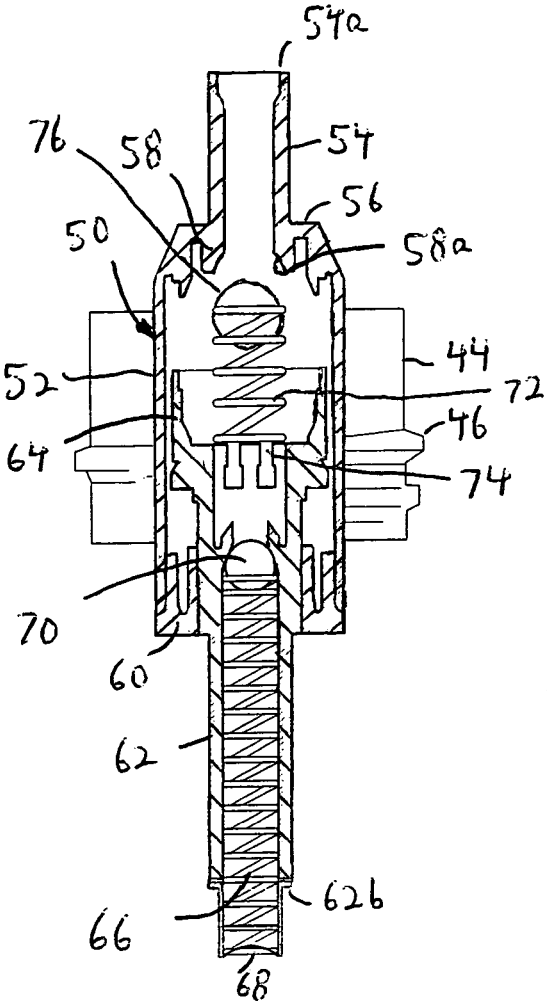
FIG. 7 is a cross-sectional view of the valve arrangement in its inoperative position.
Figure 8:
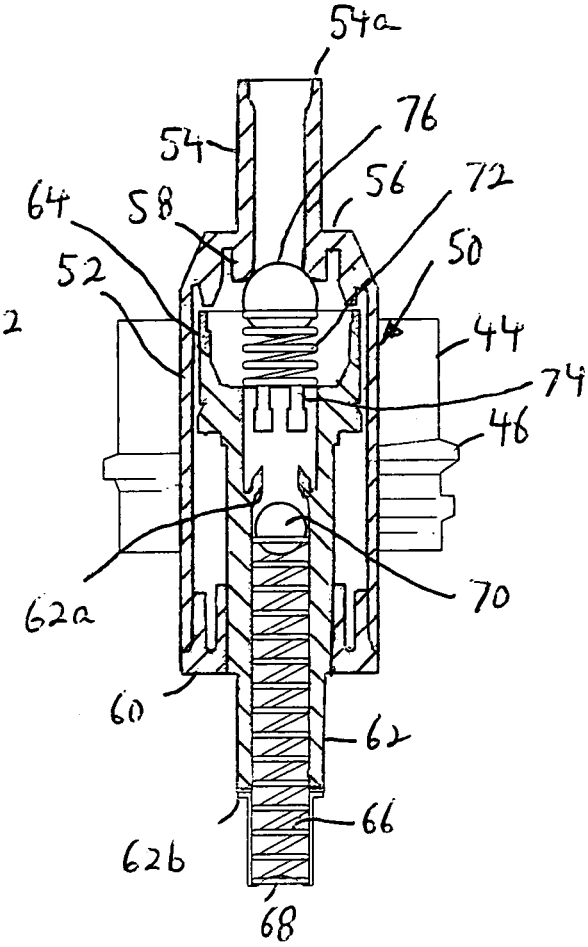
FIG. 8 is a cross-sectional view of the valve arrangement in its operative position.

In accordance with the present invention, a valve arrangement 48 is provided in neck 44 of bottle 40 for dispensing a metered amount of soap to spout 34, and then through hose barb 38 to supply tube 22. Specifically, as shown in FIGS. 5, 7 and 8, valve arrangement 48 includes an outer tube 50 having a generally cylindrical wall 52 with a reduced diameter neck 54 having an open upper end 54*a*. An annular shoulder 56 is defined between the upper end of cylindrical wall 52 and reduced diameter neck 54. Cylindrical wall 52 is fixed within reduced diameter neck 44 of bottle such that reduced diameter neck 54 extends into bottle 40 to receive soap 42 therefrom. However, reduced diameter neck 44 can be much smaller in height, or can even be eliminated in order to receive all of the soap from bottle 40. A hollow stub post 58 extends down from annular shoulder 56, coaxially with outer tube 50, and has a part spherical inner surface 58*a* at the lower end thereof. The lower end of cylindrical wall 52 is partially closed by an annular sealing member 60.

Valve arrangement 48 further includes an inner tube 62 slidably mounted within outer tube 50. The outer diameter of inner tube 62 is slightly smaller than the inner diameter of annular sealing member 60 so as to be slidably arranged therein with a sealing fit so as to prevent fluid escape. An enlarged diameter cup-shaped member 64 is secured to the upper end of inner tube 62 and is positioned within cylindrical wall 52. When bottle 40 is assembled in its upside down or inverted position shown in FIGS. 4 and 5, inner tube 62 seats within spout 34. Specifically, an annular shoulder 62*b* at the lower end of inner tube 62 mates with annular shoulder 34*a* of spout 34.

A first coil spring 66 is mounted within inner tube 62. A pin 68 or any other suitable means such as an annular shoulder is provided at the lower end of inner tube 62 for restraining the lower end of first coil spring 66. The inner surface at the upper end of inner tube 62 is formed with a part spherical surface 62*a*, and a ball 70 provided in inner tube 62 on top of the opposite end of first coil spring 66 is biased by first coil spring 66 into engagement with part spherical surface 62*a* to provide a seal thereat in the inactivated position, as shown in FIG. 7. This prevents soap 42 from entering inner tube 62.

A second coil spring 72 is mounted within enlarged diameter cup-shaped member 64, and particularly, is restrained by restraining member 74 at the lower end of enlarged diameter cup-shaped member 64, but which permits soap to pass therethrough. A ball 76 sits on the upper end of second coil spring 72, and in the inactivated position, ball 76 is positioned below and out of contact with annular shoulder 56, as shown in FIG. 7.

The opposite end of supply tube 22 is connected with venturi suction tube 16. Specifically, venturi suction tube 16 includes a main through bore 77 including a large diameter threaded inlet opening 78 for threaded connection to water line pipe 14, a smaller diameter opening 80 in open communication with inlet opening 78 and an outward flared section 79 which flares outwardly in diameter to a larger diameter outlet opening 82 at the opposite end of venturi suction tube 16.

A soap supply bore 84 is provided transversely in venturi suction tube 16, and is connected to a hose barb 86 which extends down therefrom. Hose barb 86 includes a securing section 86*a* which is secured to venturi suction tube 16 by any suitable means, such as adhesive or screw threads. A nozzle section 86*b* extends down from securing section 86*a* and has barbs 86*c* on the outer surface thereof. In this manner, the opposite end of plastic supply tube 22 can be secured over barbs 86*c* to be in fluid communication with soap supply bore 84.

In operation, in the inoperative position shown in FIG. 7, ball 70 is sealingly engaged with part spherical surface 62*a* to prevent any soap from entering inner tube 62. At the same time, ball 76 is displaced from part spherical surface 58*a* to permit soap to enter the chamber between balls 70 and 76.

When a person presses down on the bottom of inverted bottle 40, bottle 40 slides downwardly within cylindrical cup 24. Since outer tube 50 is fixed to neck 44 of bottle 40, outer tube 50 travels down with bottle 40 until it is restrained by annular shoulder 24*d*. However, the lower end of inner tube 62 is restrained by annular shoulder 34*a* of spout 34, so that outer tube 50 slides down around inner tube 62. At this time, part spherical surface 58*a* engages ball 76 and pushes it down against the force of spring 72 so as to close the chamber between balls 70 and 76. This prevents further soap from bottle 40 from entering the chamber. This, however, results in an increased pressure in this chamber. This is because this chamber is filled with soap and the volume has just been reduced, as shown in FIG. 8. The increased pressure forces ball 70 away from part spherical surface 62*a*, against the force of spring 66. Accordingly, the soap in the chamber drains down through inner tube 62 to supply line 22. Because of the water passing from water line pipe 14 to shower head 12 via venturi suction tube 16, and specifically, because of the venturi action of venturi suction tube 16, a suction is created in supply line 22. This suction results in the metered amount of soap that had just been provided to supply line 22, being sucked into soap supply opening 84 of venturi suction tube 16 and mixing with the water passing therethrough, so that a mixture of water and soap is supplied through shower head 12.

When the person releases the downward pressure on bottle 40, the pressure differential in bottle 40 and the chamber between balls 70 and 76, along with the spring pressure from coil spring 72, results in outer tube 50 sliding upwardly relative to inner tube 62, to return to the position shown in FIG. 7. Since the pressure on ball 70 is released, spring 66 once again biases ball 70 into engagement with part spherical surface 62*a* to seal off inner tube 62. Thus, once again the chamber fills with soap, ready for another dispensing operation.

Thus, in accordance with the present invention, a soap dispenser system and valve arrangement therefor is provided in which a metered amount of the soap is delivered to the shower head to mix with the water. Further, soap dispenser 18 is easily activated by an invalid pressing down on the top of bottle 40.

Referring now to FIGS. 10–16, there is shown a modified soap dispenser system 110 according to the present invention in which common elements are referenced by the same reference numerals, but augmented by 100, and a detailed description of the common elements will be omitted.

Figure 10:
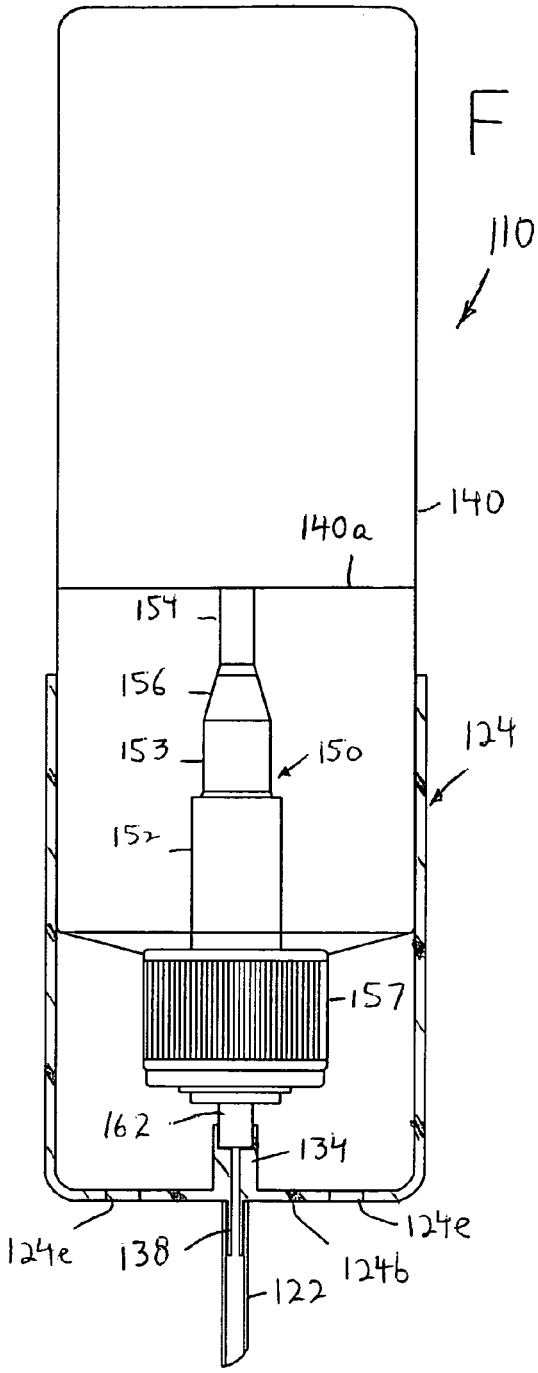
FIG. 10 is a partial cross-sectional view of a soap dispenser system and valve arrangement therefor according to a second embodiment of the present invention.
Figure 11:
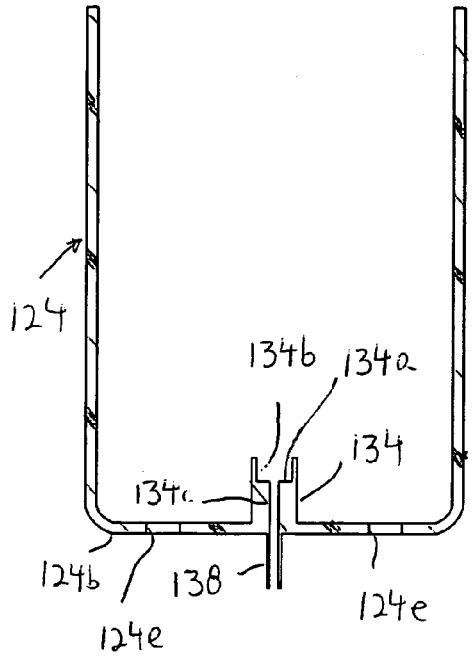
FIG. 11 is a cross-sectional view of the cup of FIG. 10.

Referring first to FIGS. 10 and 11, a cylindrical cup 124 includes an inwardly extending central post 134 having a central circular recess 134*b* at the upper portion thereof and a through bore 134*c* extending from the lower end of recess 134*b* through the lower end of cup 124. In this manner, a lower annular shoulder 134*a* is defined at the lower wall of recess 134*b* in surrounding relation to through bore 134*c*. A small diameter stub tube 138 extends downwardly from the lower surface of bottom wall 124*b* of cup 124 in surrounding relation to through bore 134*c* in order to frictionally receive one end of a tube 122, the other end of which connects to venturi suction tube 16 associated with shower head 12. In addition, bottom wall 124*b* of cup 124 includes a plurality of openings 124*e* therein.

By providing a raised up post 134 extending within cup 124 and openings 124*e* in bottom wall 124*b*, bottle 140 sits above the upper surface of bottom wall 124*b* of cup 124. This allows water that enters between cup 124 and bottle 140 to drain out, and also provides for air to enter in through openings 124*e* and enter through bore 134*c* which has a sloppy or loose fit with inner tube 162 of valve arrangement 148. It has been found that the additional air entering into through bore 134*c* from openings 124*e* provides for more aeration of the water, resulting in a greater lather of the soap exiting shower head 12. Specifically, with soap dispenser system 10 according to the first embodiment of FIGS. 1–9, the lather of the soap was not as great as compared with soap dispenser system 110 of the embodiment of FIGS. 10–16.

Further, unlike conventional devices which require an on/off knob or button and in which any suction is lost when the knob is turned to the off position, there is always a constant suction with the present invention, as long as the shower is running. This constant suction allows the shower head 12 to constantly have air sucked into it, aerating the shower and creating more volume which makes for an economical and faster shower, particularly when the soap is added. This is enhanced further by the use of openings 124*e* which permit even more air to enter.

In addition, there is a disadvantage of soap dispenser system 10 according to the first embodiment in that some soap could remain in spout 34 and be captured in threads 36. If water from the shower traveled between cup 24 and bottle 40, the soap held by threads 36 would lather up. Because of suction in tube 22, the lathered soap would be sucked up into shower head 12 at a time when soap was not desired. By using small diameter stub tube 138 in place of spout 34, no soap remains therein after cut-off by valve arrangement 148, and no soap coats the inner walls of tube 138. For example, stub tube 138 can have an outer diameter of approximately 3 mm and an inner diameter of approximately 2 mm. Therefore, this problem of soap retention and undesirable lather is effectively eliminated. Further, the use of a smaller tube 138 in place of spout 34 and hose barb 38 also reduces the size of soap dispenser system 110 and results in a faster delivery time and better cut-off of soap.

Figure 12:
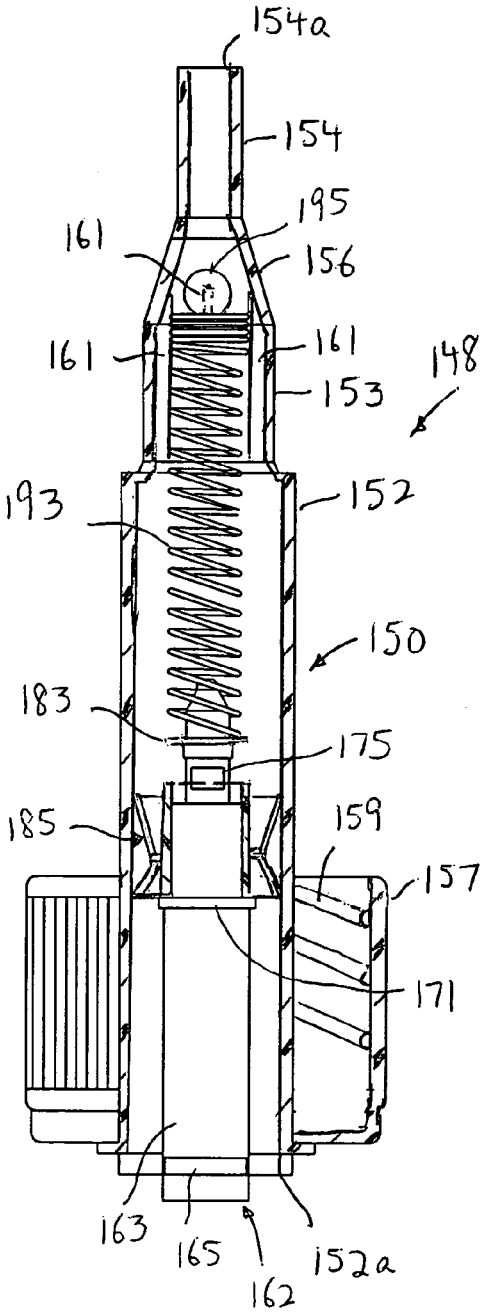
FIG. 12 is a cross-sectional view of the valve arrangement of FIG. 10 when the bottle is depressed.
Figure 13:
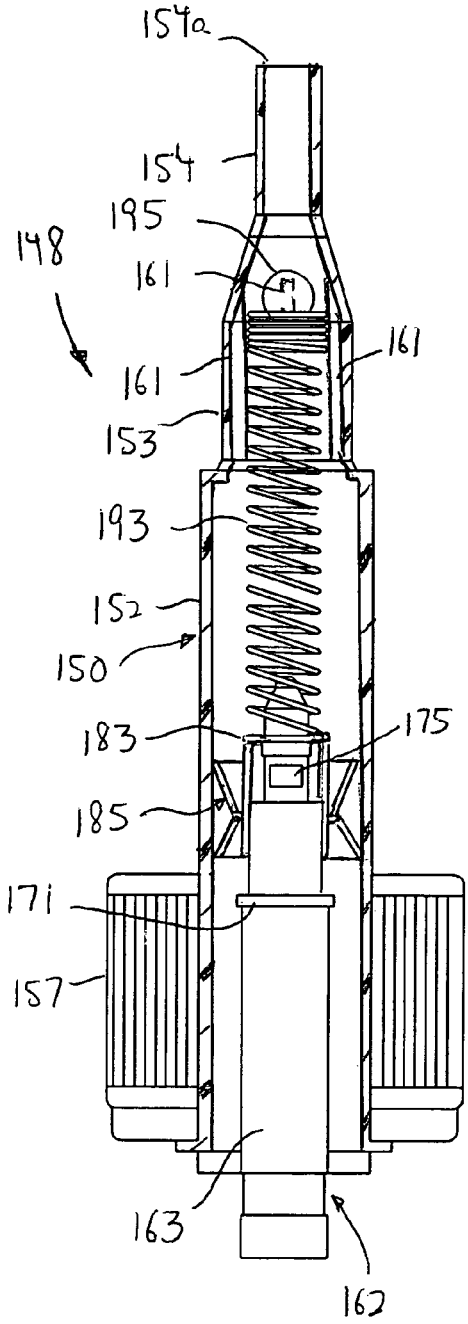
FIG. 13 is a cross-sectional view of the valve arrangement of FIG. 10 when the bottle is not depressed.
Figure 14:
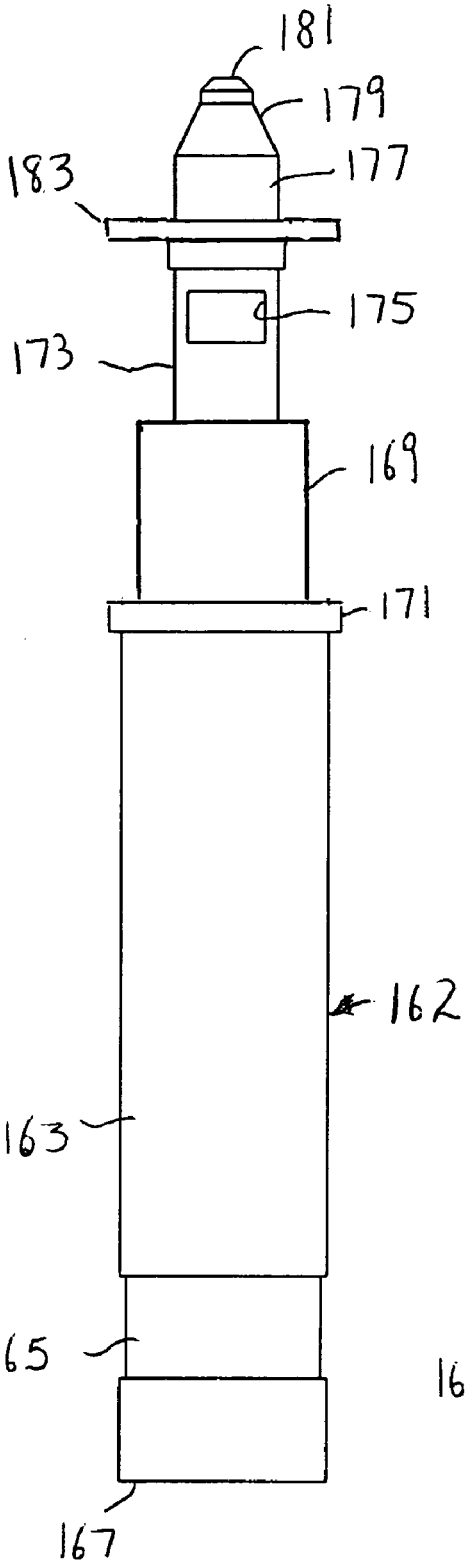
FIG. 14 is an elevational view of the inner tube of the valve arrangement of FIGS. 12 and 13.
Figure 15:
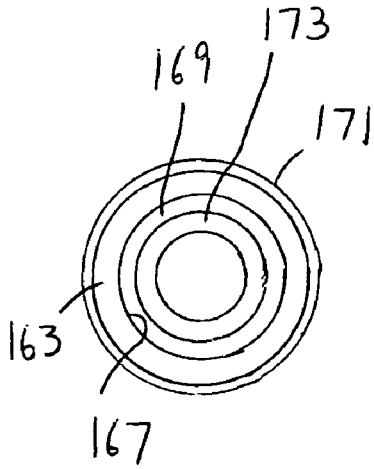
FIG. 15 is a bottom plan view of the inner tube of FIG. 14.

As shown best in FIGS. 12 and 13, valve arrangement 148 has also changed from valve arrangement 48 of the first embodiment. Valve arrangement 148 has been modified from a commercially available valve arrangement sold by Emsar, Inc., 125 Access Road, Stratford, Conn. 06615, which is presently used for a dispenser pump for a bottle. The present invention uses much of the Emsar valve arrangement, but in an inverted configuration from the present use thereof, and removes various components therefrom.

Specifically, valve arrangement 148 is provided in the neck of bottle 140 for dispensing soap to through bore 134*c*, and then through stub tube 138 to supply tube 122. Specifically, valve arrangement 148 includes an outer tube 150 having a generally cylindrical lower wall 152 which is connected at its upper end to a smaller diameter generally cylindrical wall 153, which in turn, is connected at its upper end to a tapering frusto-conical wall 156, which in turn, is connected at its upper end with a reduced diameter neck 154 having an open upper end 154*a*. The lower end of cylindrical lower wall 152 is open at 152*a*. In addition, the inner surface of cylindrical wall 153 is provided with inwardly extending ribs 161 that extend partially along the inner surface of frusto-conical wall 156.

Cylindrical wall 152 is rotatably mounted to a cap 157 which is shown in cross-section on the right side of FIG. 12 and has internal threads 159 for threadedly securing cap 157 to the threaded neck of bottle 140. In this manner, reduced diameter neck 154 extends into bottle 140 to receive soap therefrom.

Valve arrangement 148 further includes an inner tube 162 with a hollow cylindrical section 163 having a circumferential recess 165 spaced slightly from the open lower end 167 thereof. The outer diameter of cylindrical section 163 is less than the inner diameter of cylindrical wall 152 of outer tube 150 so as to permit inner tube 162 to freely move within cylindrical wall 152. The upper end of cylindrical section 163 is connected to a hollow, smaller. diameter cylindrical section 169. An annular stop 171 is connected around the lower end of cylindrical section 169 and has an outer diameter greater than the outer diameter of cylindrical section 163. The upper end of cylindrical section 169 is connected to a hollow, smaller diameter cylindrical section 173 having a curved rectangular opening 175 near the upper end thereof. The upper end of cylindrical section 173 is connected to a solid cylindrical section 177 of similar diameter, which in turn, has its upper end connected to a tapering solid frusto-conical section 179 with a closed upper end 181. An annular stop 183 of similar outer diameter to annular stop 171 is connected to the lower end of cylindrical section 177 in spaced relation above opening 175.

Figure 16:
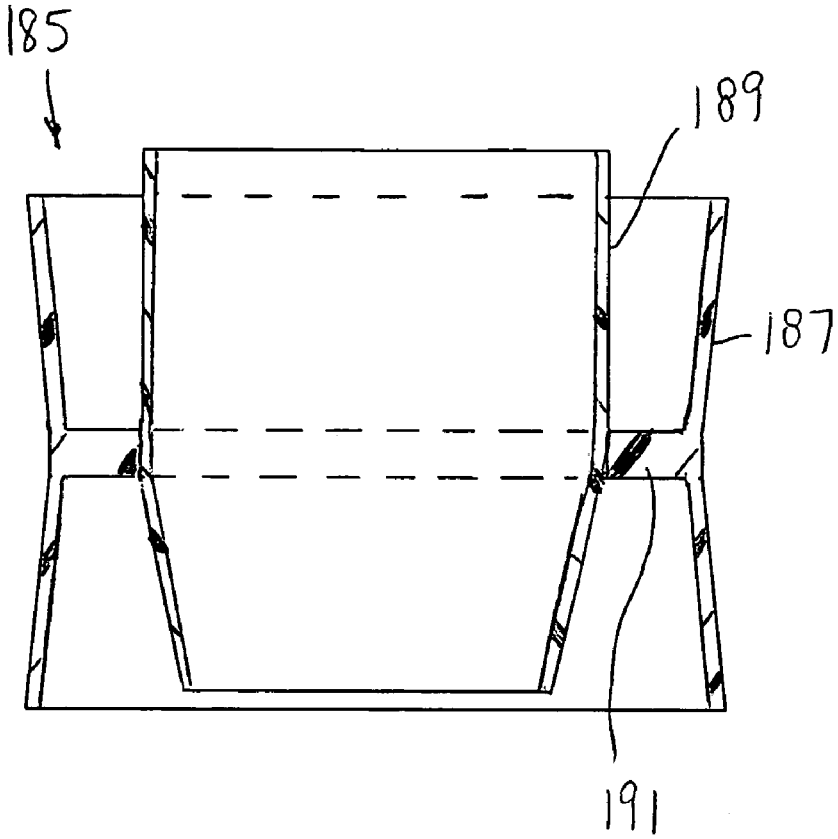
FIG. 16 is a cross-sectional view of the valve of the valve arrangement of FIG. 10.

As best shown in FIG. 16, valve arrangement 148 further includes a valve 185 slidably mounted on inner tube 162 for movement between an upper position limited by annular stop 183 and a lower position limited by annular stop 171. Valve 185 is made of a rubber, plastic or rubberized plastic material that is slightly flexible. Valve 185 includes an outer circumferential wall 187 which tapers in diameter toward a mid-section thereof and an inner circumferential wall 189 spaced inwardly from outer circumferential wall 187 and connected at a mid-section thereof by an annular connecting wall 191. The upper edge of inner circumferential wall 189 is spaced slightly higher than the upper edge of outer circumferential wall 187, although the present invention is not limited thereto. The outer diameter of outer circumferential wall 187 at the upper and lower edges thereof is slightly larger than the inner diameter of cylindrical section 152 of outer tube 150. As a result, outer circumferential wall 187 can slide along the inner surface of cylindrical section 152 with a friction sliding arrangement. On the other hand, the inner diameter of inner circumferential wall 189 is of a similar diameter to the outer diameter of hollow cylindrical section 169, and is therefore slidably therealong, but is restrained at its upper edge by annular stop 183 and at its lower edge by annular stop 171. As will be appreciated from the discussion hereafter, the frictional engagement by outer circumferential wall 188 with cylindrical section 152 is greater than the frictional engagement by inner circumferential wall 189 with hollow cylindrical section 169.

As shown in FIGS. 10 and 11, inner tube 162 having valve 185 positioned therearound, is inserted into outer tube 150. A coil spring 193 has one end engaged around solid cylindrical section 177 and solid frusto-conical section 179, and rests on the upper surface of annular stop 183. The opposite end of coil spring 193 is restrained at its upper end by ribs 161. A free floating ball 195 rests on the upper end of coil spring 193.

An annular spacer (not shown) is also preferably provided between cylindrical section 163 of inner tube 162 and cylindrical wall 152 of outer tube 150 to permit relative rotation therebetween, to reduce free play, thereby ensuring that outer tube 150 and inner tube 162 remain concentric with each other.

In operation, lower end 167 of inner tube 162 is positioned with a loose or sloppy fit in recess 134*b* of central post 134, as shown in FIG. 10. In this position, with no external downward force being applied to bottle 140, spring 193 biases inner tube 162 down to the position shown in FIG. 13. Since the lower end 167 of inner tube 162 is seated in recess 134*b*, this has the effect of forcing bottle 140 upwardly within cup 124. As shown in FIG. 13, the upper edge of inner circumferential wall 189 of valve 185 abuts against the underside of annular stop 183, thereby closing off opening 175 to prevent any soap from bottle 140 or from the chamber between outer tube 150 and inner tube 162, entering opening 175. In this position, ball 195 rests on the upper end of spring 193.

When a person presses down on bottle 140, bottle 140 is moved downwardly in cup 124. This results in cap 157 and outer tube 150, which are connected to bottle 140, also moving downwardly. Since the lower end 167 of inner tube 162 is constrained in recess 134*b*, coil spring 193 is compressed. Because of frictional engagement by outer circumferential wall 187 with cylindrical wall 152, valve 185 is moved down with cylindrical wall 152 until the lower edge of inner circumferential wall 189 abuts against the upper surface of annular stop 171. In this position, opening 175 is exposed, so that soap from bottle 140 can flow through open upper end 154*a* through the annular space between outer tube 150 and inner tube 162 and is thereby delivered to supply tube 122, where it is suctioned to the shower head in the manner described in the first embodiment of FIGS. 1–9.

During the initial pressing down on bottle 140, because there is some soap from bottle 140 already filling the annular space between outer tube 150 and inner tube 162, the raising up of inner tube 162 into outer tube 150, as shown in FIG. 12, results in a decrease in volume, and therefore, an increase in pressure therein. This increased pressure serves to push ball 195 up against the upper end of frusto-conical wall 156, preventing further soap from entering therein. As the soap drains through opening 175, the pressure reduces and ball 195 falls back down onto the upper end of spring 193.

This has the advantage that the second embodiment can operate to dispense a metered dosage of soap, or a continuous supply of soap. Specifically, if bottle 140 is depressed down and immediately let up, a small metered dose of soap will enter opening 175 for dispensing with the water from the shower head. On the other hand, if bottle 140 is depressed down and a continuous pressure is applied thereto, opening 175 remains open, so that the soap within outer tube 150 will continuously drain, and additional soap from bottle 140 that enters outer tube 150 after ball 195 falls down, will also drain through opening 175, until the external pressure on bottle 140 is released.

Once the external pressure on bottle 140 is released, spring 193 again forces bottle 140 upwardly. This carries valve 185 therewith until the upper edge of inner circumferential wall 189 abuts against the underside of annular stop 171, thereby once again closing off opening 175.

Figure 23:
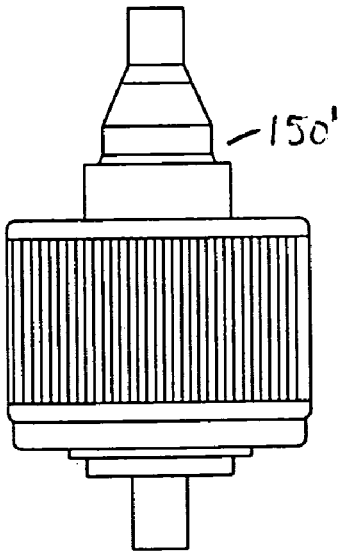
FIG. 23 is an elevational view of cap and valve assembly with a shorter outer tube.

Of course, it will be appreciated that, in order to dispense all of the soap in bottle 140, a wall 140*a* can be provided as a lower wall for the soap, with wall 140*a* coplanar with the upper surface of reduced diameter neck 154 and having an opening coaxial with the upper opening of reduced diameter neck 154. In such case, no soap would extend below wall 140*a*. Alternatively, outer tube 150 can be made shorter, as with outer tube 150' of FIG. 23. In such case, the relative elements would also be modified in size accordingly, and wall 140*a* could be eliminated.

Figure 17:
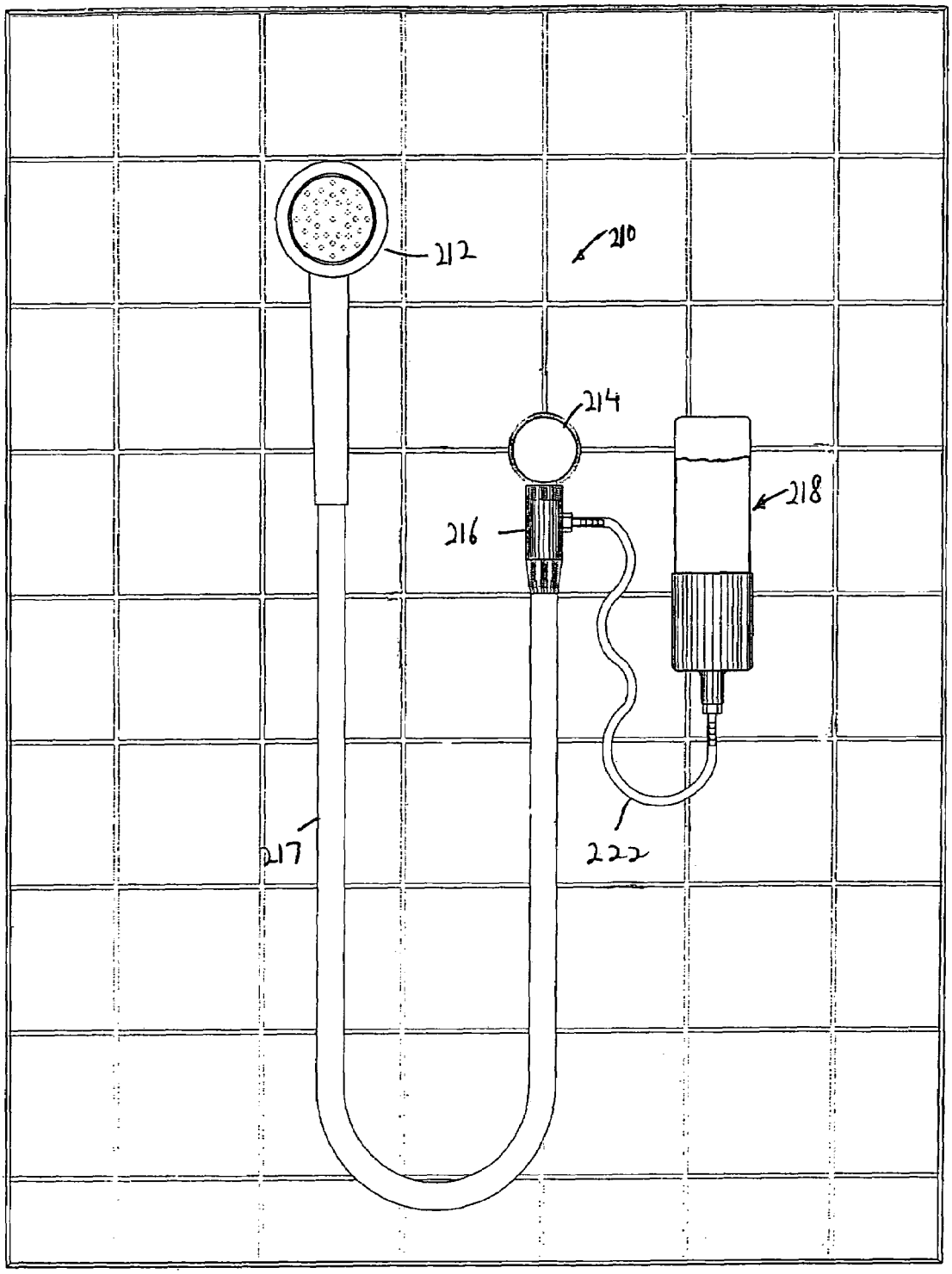
FIG. 17 is an elevational view of a modified soap dispenser system according to the present invention.

Referring now to FIG. 17, there is shown a modified soap dispenser system 210 according to the present invention in which common elements are referenced by the same reference numerals as the embodiment of FIGS. 1–9, but augmented by 200, and a detailed description of the common elements will be omitted. In this embodiment, the outlet of venturi suction tube 216 is connected via a tube 217 to a hand-held shower head 212. Further, venturi suction tube 216 is connected to water line pipe 214 at a position close to the wall, with supply line 222 connecting soap dispenser 218 to venturi suction tube 216.

Figure 18:
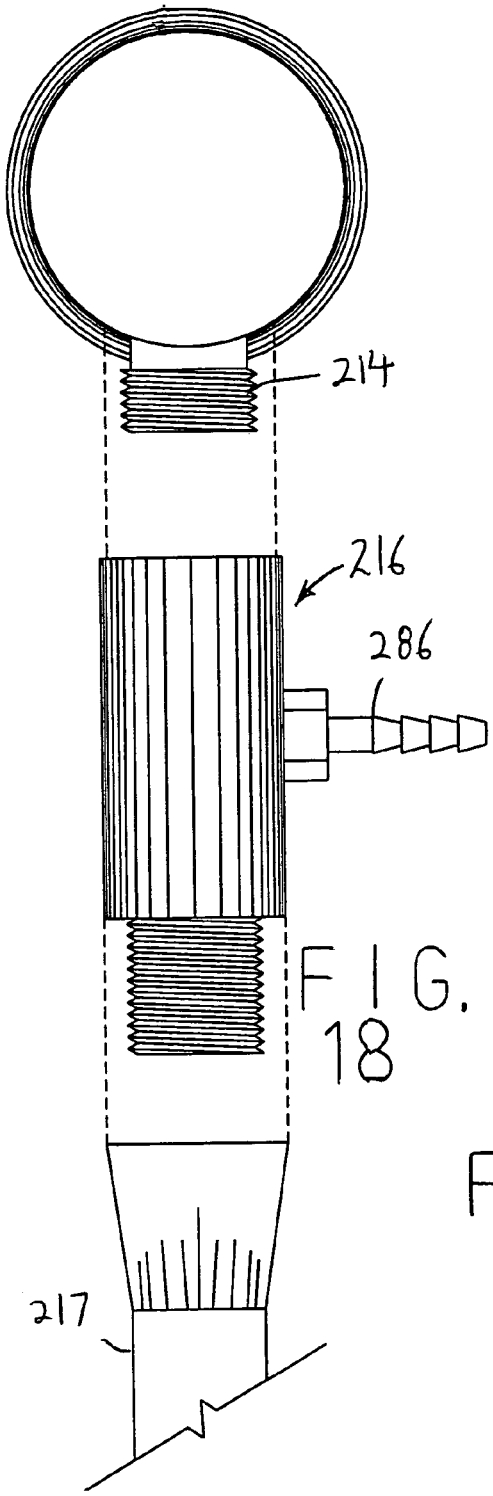
FIG. 18 is a blown apart, elevational view of the venturi suction tube of FIG. 9 and water line pipe of FIG. 17.
Figure 19:
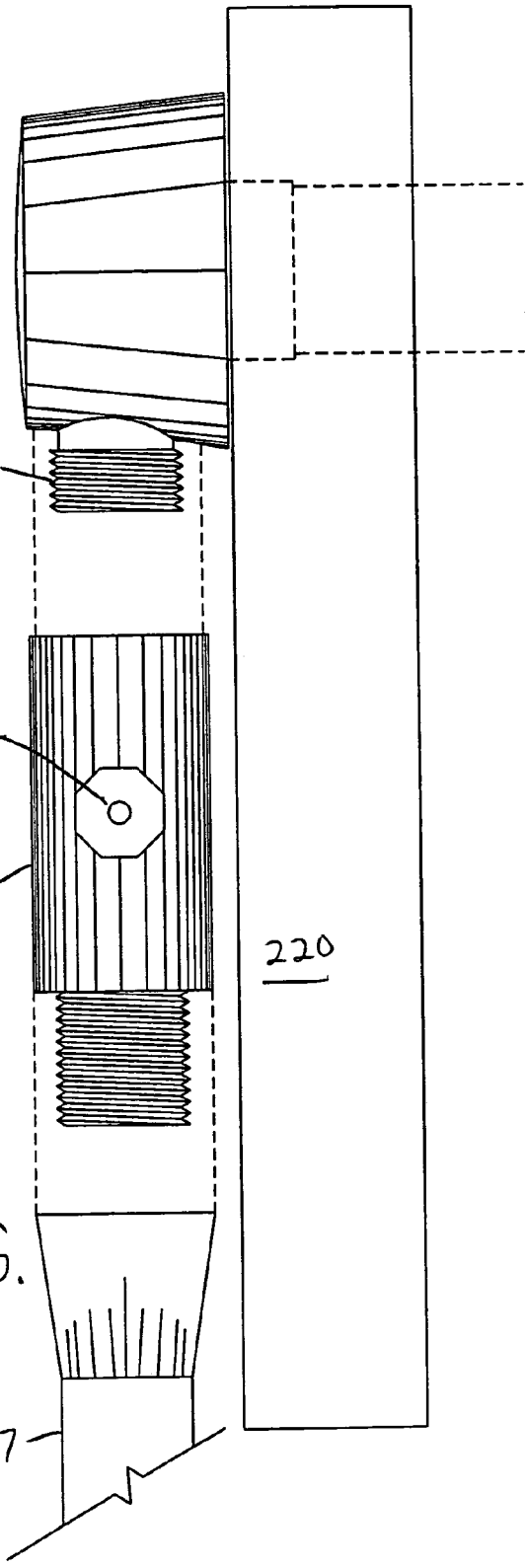
FIG. 19 is a blown apart, elevational view of the venturi suction tube and water line pipe of FIG. 18, from a view 90 degrees turned from FIG. 18.

As shown best in FIGS. 18 and 19, with the modified soap dispenser system 210, venturi suction tube 216 is positioned close to shower wall 220. In such case, because hose barb 286 extends outwardly therefrom, there is a problem attaching venturi suction tube 216 to water line pipe 214.

Figure 20:
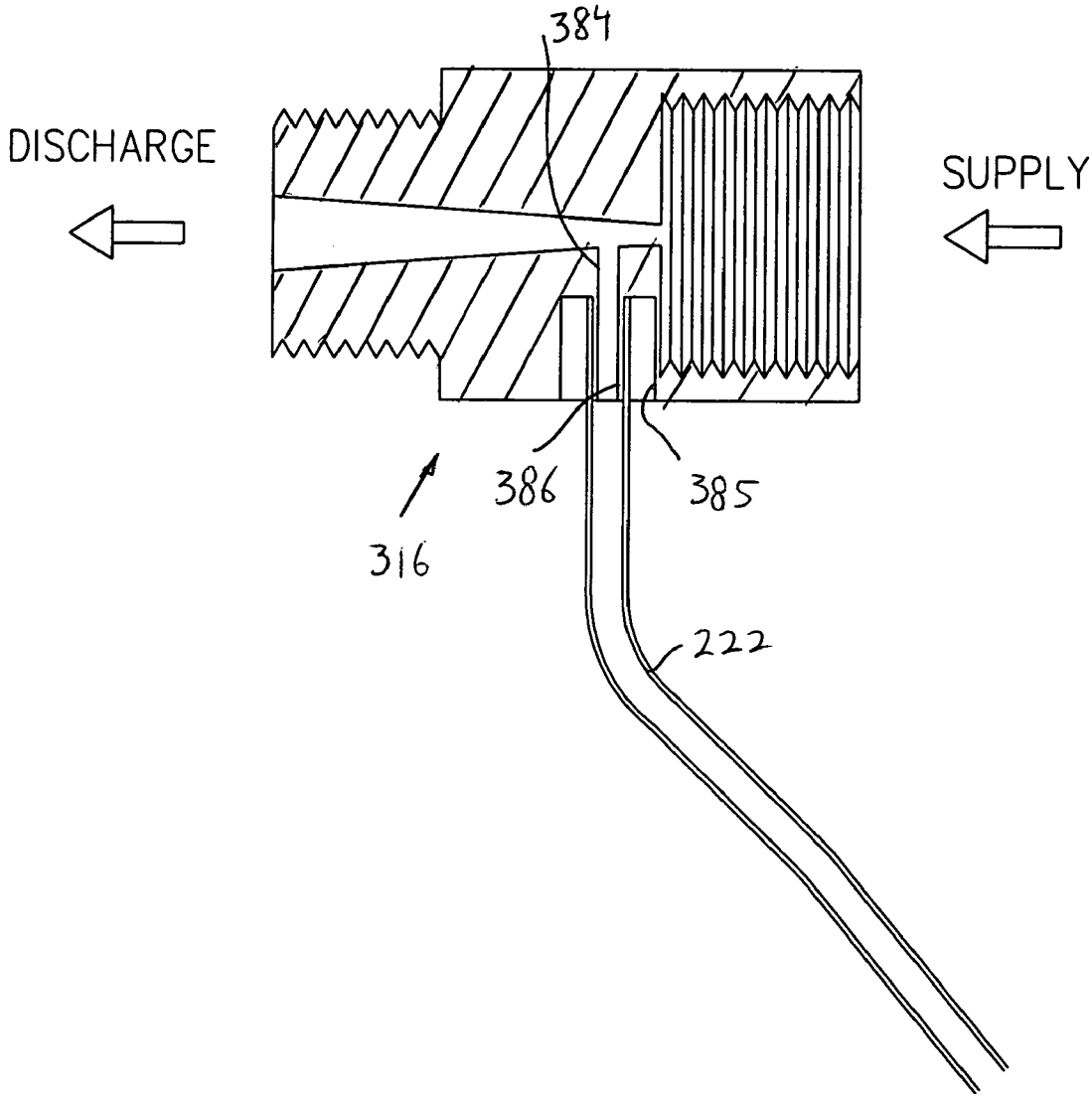
FIG. 20 is a cross-sectional view of a venturi section tube according to another embodiment of the present invention.

In this regard, according to the present invention, a modified venturi suction tube 316 will now be described in relation to FIG. 20 which elements common to venturi suction tube 16 are identified by the same reference numerals, but augmented by 300. Specifically, in place of barb 86, venturi suction tube 316 includes an annular recess 385 having a central hollow post 386 therein which is in fluid communication with soap supply bore 384 and which extends radially out therefrom. The free end of hollow post 386 is substantially flush with the outer surface of venturi suction tube 316. As a result, venturi suction tube 316 can be threadedly connected with water line pipe 214 which is close to shower wall 220 in FIG. 19, and supply tube 222 can then be fit over post 386.

Figure 21:
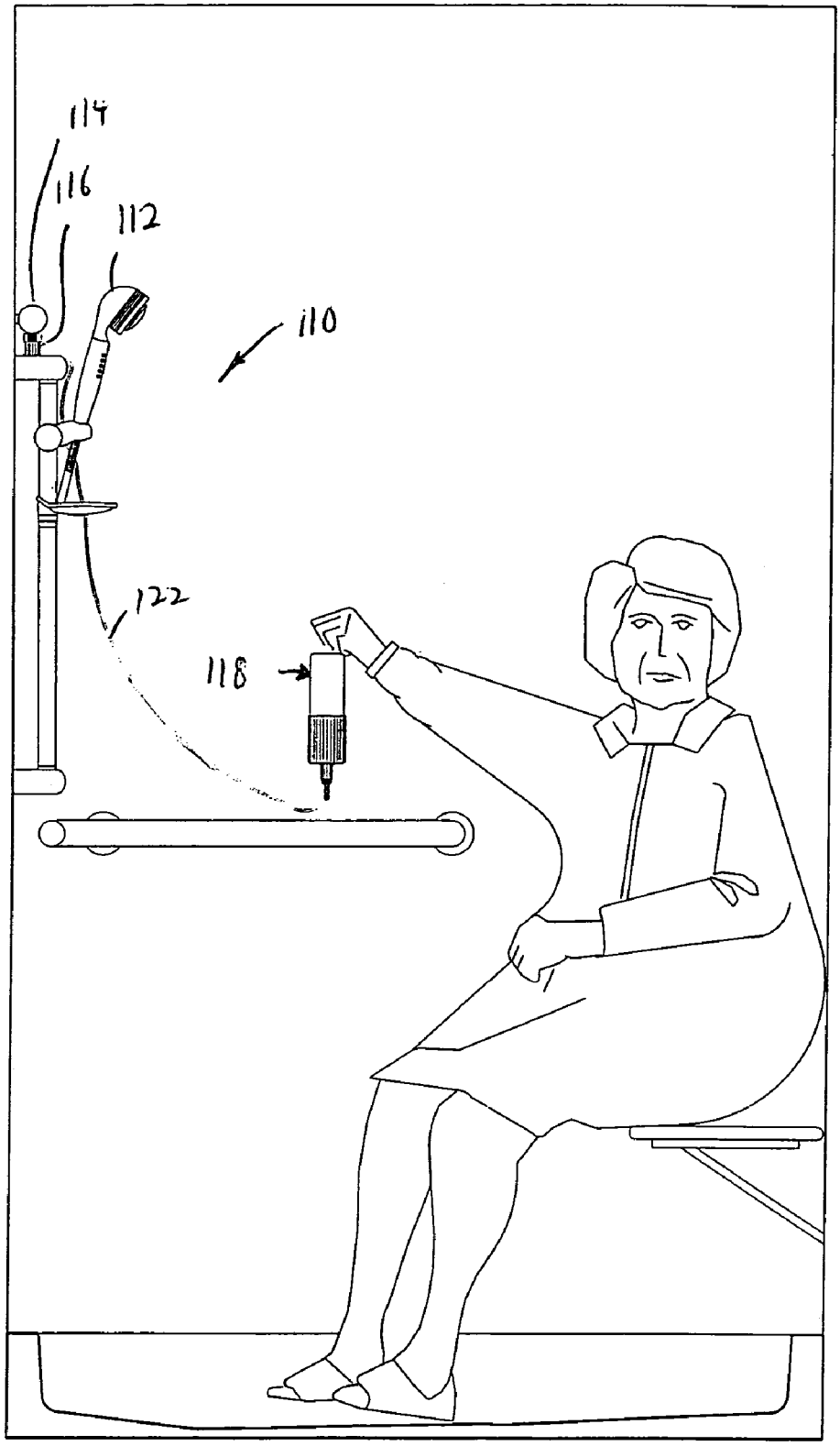
FIG. 21 is an elevational view of a further modified soap dispenser system according to the present invention.

FIG. 21 shows use of soap dispenser system 110 by an invalid in the manner of shower dispenser system 10 of FIGS. 1–9.

It will be appreciated that various modifications can be made to the present invention within the scope of the claims. For example, FIG. 22 shows a modified arrangement in which bottle 40 has a bottom closure lid 40*a* that is connected by a living hinge 40*b* so that bottle 40 can be refilled.

As a further modification, supply tube 22, 122 can be removed and cup 24, 124 can be used with bottle 140 as a hand soap dispenser for dispensing a metered dosage of soap to a person's hands. In such case, the person can press down on bottle 140 in the shower to deliver a metered dosage of soap for bathing. At the same time, air is still sucked in through tube 22, 122 to aerate the shower head 12.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A soap dispenser system comprising:

a suction tube including:

a main through bore for supplying water from a water line pipe to a shower head, and a soap supply bore intersecting said main through bore;

a soap dispenser positioned remote from the suction tube for controlling dispensing of soap from a container having soap therein; and a supply tube connecting the soap dispenser to the soap supply bore of the suction tube in order to provide soap from said soap dispenser to said suction tube by means of suction created by the water traveling through the main through bore of the suction tube;

the soap dispenser including:

an inner tube having an inlet and an outlet fluidly connected with said supply tube, an outer tube movably mounted over said inner tube and connected with the container, said outer tube having an inlet adapted to be fluidly connected with soap from the container and an outlet adapted to be fluidly connected with the inlet of the inner tube, a biasing device for applying pressure between said inner tube and said outer tube in a direction to move said inner tube and outer tube apart, a valve device which includes a separate element from the inner tube and the outer tube for permitting liquid soap to enter said inlet of said inner tube when said outer tube is moved toward the inner tube against the force of said biasing device and which prevents liquid soap from entering said inlet of said inner tube when said outer tube is moved away from the inner tube by said biasing device.

2. A soap dispenser system according to claim 1, wherein said valve device includes a member which covers said inlet of said inner tube when said biasing device moves said inner tube and said outer tube apart and which uncovers said inlet of said inner tube when said outer tube is moved toward the inner tube against the force of said biasing device.

3. A soap dispenser system according to claim 2, wherein said member of said valve device includes an inner wall which covers and uncovers said inlet of said inner tube and an outer wall connected with said inner wall and which engages with said outer tube for moving said inner wall relative to said inner tube to cover and uncover said inlet of said inner tube.

4. A soap dispenser system according to claim 3, wherein said inner tube includes a first stop for limiting movement of said inner wall therealong in a first direction to a first position in covering relation to said opening and a second stop for limiting movement of said inner wall therealong in a second opposite direction to a second position in uncovering relation to said opening.

5. A soap dispenser system according to claim 3, wherein said outer wall is in frictional engagement with said outer tube.

6. A soap dispenser system according to claim 1, wherein said biasing device includes a coil spring connected between said inner tube and said outer tube.

7. A soap dispenser system comprising:

a suction tube including:

a main through bore for supplying water from a water line pipe to a shower head, and a soap supply bore intersecting said main through bore;

a soap dispenser positioned remote from the suction tube for controlling dispensing of soap from a container having soap therein; and a supply tube connecting the soap dispenser to the soap supply bore of the suction tube in order to provide soap from said soap dispenser to said suction tube by means of suction created by the water traveling through the main through bore of the suction tube;

the soap dispenser including:

an inner tube having an inlet and an outlet fluidly connected with said supply tube, an outer tube movably mounted over said inner tube and connected with the container, said outer tube having an inlet adapted to be fluidly connected with soap from the container and an outlet adapted to be fluidly connected with the inlet of the inner tube, a biasing device for applying pressure between said inner tube and said outer tube in a direction to move said inner tube and outer tube apart, said biasing device including a coil spring connected between said inner tube and said outer tube, a valve for permitting soap to enter said inlet of said inner tube when said outer tube is moved toward the inner tube against the force of said biasing device and which prevents soap from entering said inlet of said inner tube when said outer tube is moved away from the inner tube by said biasing device, and a free floating ball between said spring and said outer tube for providing a seal of the inlet of said outer tube when said outer tube is moved toward the inner tube against the force of said biasing device and which releases the seal of the inlet of said outer tube when said outer tube is maintained in a position moved toward the inner tube.

8. A soap dispenser system according to claim 1, wherein said outer tube is secured to a neck of the container.

9. A soap dispenser system according to claim 1, wherein said suction tube is a venturi suction tube having a main through bore which flares outwardly in diameter from an inner end to an outer end thereof.

10. A soap dispenser system according to claim 1, wherein the valve device of the soap dispenser includes:

a first biased seal for permitting soap to travel through said inner tube when a release force is applied to said container and for preventing soap to travel through said inner tube when a the release force is not applied to said container, a second biased seal for preventing soap from escaping from said container through said outer tube when the release force is applied to said container and for permitting soap to escape from said container through said outer tube when the release force is not applied to said container, and a chamber between said first and second biased seals for accumulating a metered dosage of soap for supply to said supply tube, such that said chamber is loaded with said metered dosage of soap when the release force is not applied to said container, and the metered dosage of soap is supplied through said inner tube when the release force is applied to said container.

11. A soap dispenser system according to claim 10, wherein said inner tube includes an inner sealing surface and said first biased seal includes a ball and a spring mounted in said inner tube for biasing said ball into sealing engagement with said inner sealing surface.

12. A soap dispenser system according to claim 11, wherein said inner sealing surface is a part-spherical surface.

13. A soap dispenser system according to claim 10, wherein said outer tube includes an inner sealing surface and said second biased seal includes a ball and a spring mounted in said outer tube between said inner tube and the ball for biasing said ball into sealing engagement with said inner sealing surface.

14. A soap dispenser system according to claim 13, wherein said inner sealing surface is a part-spherical surface.

15. A soap dispenser system according to claim 1, wherein said soap supply bore is fluidly connected to said main through bore adjacent said inner end.

16. A soap dispenser system comprising:

a suction tube including:

a main through bore for supplying water from a water line pipe to a shower head, and a soap supply bore intersecting said main through bore, an outer surface having a recess therein, and a hollow central post in said recess which is in fluid communication with said soap supply bore, said hollow central post having a free end which substantially does not extend radially outward past said outer surface;

a soap dispenser positioned remote from the suction tube for controlling dispensing of soap from a container having soap therein; and a supply tube connecting the soap dispenser to the scan supply bore of the suction tube in order to provide soap from said soap dispenser to said suction tube by means of suction created by the water traveling through the main through bore of the suction tube;

the soap dispenser including:

an inner tube having an inlet and an outlet fluidly connected with said supply tube, an outer tube movably mounted over said inner tube and connected with the container, said outer tube having an inlet adapted to be fluidly connected with soap from the container and an outlet adapted to be fluidly connected with the inlet of the inner tube, a biasing device for applying pressure between said inner tube and said outer tube in a direction to move said inner tube and outer tube apart, a valve for permitting soap to enter said inlet of said inner tube when said outer tube is moved toward the inner tube against the force of said biasing device and which prevents soap from entering said inlet of said inner tube when said outer tube is moved away from the inner tube by said biasing device.

17. A soap dispenser system according to claim 1, wherein said soap dispenser includes a cup adapted to be mounted to a wall of a shower, the cup having a spout connected with said supply tube, and the inner tube being mounted in said cup in fluid communication with said spout.

18. A soap dispenser system according to claim 17, wherein said cup includes a bottom wall and an internal boss connected with said bottom wall for mounting said container in spaced relation from said bottom wall.

19. A soap dispenser system according to claim 17, wherein:

said cup includes a bottom wall having at least one opening therein, and said container is in spaced relation from said bottom wall.

* * * * *